US011041497B1

(12) United States Patent
Nakaniwa et al.

(10) Patent No.: US 11,041,497 B1
(45) Date of Patent: Jun. 22, 2021

(54) CENTRIFUGAL ROTARY MACHINE

(71) Applicant: MITSUBISHI HEAVY INDUSTRIES COMPRESSOR CORPORATION, Tokyo (JP)

(72) Inventors: Akihiro Nakaniwa, Tokyo (JP); Shinichiro Tokuyama, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 576 days.

(21) Appl. No.: 16/074,281

(22) PCT Filed: Feb. 8, 2017

(86) PCT No.: PCT/JP2017/004564
§ 371 (c)(1),
(2) Date: Jul. 31, 2018

(87) PCT Pub. No.: WO2017/138560
PCT Pub. Date: Aug. 17, 2017

(30) Foreign Application Priority Data

Feb. 8, 2016 (JP) ..... JP2016-021939

(51) Int. Cl.
*F04D 17/12* (2006.01)
*F04D 27/02* (2006.01)
(Continued)

(52) U.S. Cl.
CPC ..... *F04D 17/122* (2013.01); *F04D 29/16* (2013.01); *F04D 29/4206* (2013.01); *F04D 29/441* (2013.01)

(58) Field of Classification Search
CPC .... F04D 17/122; F04D 29/16; F04D 29/4206; F04D 29/441; F04D 27/02;
(Continued)

(56) References Cited

U.S. PATENT DOCUMENTS 4,375,938 A * 3/1983 Dussourd ..... F04D 15/00 415/143
4,990,053 A * 2/1991 Rohne ..... F04D 29/685 415/58.4
(Continued)

FOREIGN PATENT DOCUMENTS

JP S59-71998 U 5/1984
JP S63-106400 A 5/1988
(Continued)

OTHER PUBLICATIONS

International Search Report issued in corresponding International Application No. PCT/JP2017/004564 dated Mar. 21, 2017, with translation (4 pages).
(Continued)

*Primary Examiner* — Woody A Lee, Jr.
*Assistant Examiner* — Brian O Peters
(74) *Attorney, Agent, or Firm* — Osha Bergman Watanabe & Burton LLP

(57) ABSTRACT

A centrifugal rotary machine includes: an impeller which includes a disk, blades, and a cover; and a sealing device which seals the gap, in which the casing includes an end wall surface which defines a radial flow path between the end wall surface and a cover end surface, an inlet-side inner peripheral surface which is connected to a radially inner side of the end wall surface and extends to the one side in the axial direction so as to define an introduction flow path of a fluid to the impeller, and a circulation flow path which is formed in the casing and is open to an end portion on a radially outer side of the end wall surface and the inlet-side inner peripheral surface to cause the radial flow path and the introduction flow path to communicate with each other.

14 Claims, 5 Drawing Sheets

(51) Int. Cl.
*F04D 29/42* (2006.01)
*F04D 29/44* (2006.01)
*F04D 29/16* (2006.01)

(58) Field of Classification Search
CPC ..... F04D 27/0207; F04D 27/0215; F04D 27/023; F04D 27/0238
See application file for complete search history.

(56) References Cited

U.S. PATENT DOCUMENTS 5,201,801 A 4/1993 Smith, Jr.
6,447,241 B2 * 9/2002 Nakao ..... F04D 29/4213 415/1
8,272,832 B2 * 9/2012 Yin ..... F04D 29/4213 415/58.4
9,003,791 B2 * 4/2015 Ibaraki ..... F02C 3/34 60/603
10,634,157 B2 * 4/2020 Rubino ..... F04D 17/122
2014/0202202 A1 7/2014 Taguchi et al.

FOREIGN PATENT DOCUMENTS

JP S63-266199 A 11/1988
JP H05-156966 A 6/1993
JP H07-071398 A 3/1995
JP H07-174097 A 7/1995
JP 2003-106299 A 4/2003
WO 2013/140819 A1 9/2013

OTHER PUBLICATIONS

Written Opinion of the International Searching Authority issued in corresponding International Application No. PCT/JP2017/004564 dated Mar. 21, 2017, with translation (9 pages).
The Notice of Reasons for Refusal issued in corresponding Japanese Application No. 2016-021939, dated Jun. 30, 2020 (8 pages).

* cited by examiner

CENTRIFUGAL ROTARY MACHINE

TECHNICAL FIELD

The present invention relates to a centrifugal rotary machine. Priority is claimed on Japanese Patent Application No. 2016-021939, filed on Feb. 8, 2016, the content of which is incorporated herein by reference.

BACKGROUND ART

In general, a centrifugal rotary machine includes an impeller which is provided on a rotary shaft and a casing which covers the impeller. When the impeller of the centrifugal rotary machine is rotated in the casing, if foreign particles such as sand or dust enter a portion between the impeller and the casing, the impeller or the casing may be damaged.

For example, Patent Document 1 discloses a sizing device which reduces an amount of foreign particles which enter a compressor of a gas turbine engine which is a type of rotary machine.

CITATION LIST

Patent Literature

Patent Document 1: Japanese Unexamined Patent Application, First Publication No. H5-156966

SUMMARY OF INVENTION

Technical Problem

In a case where the foreign particles flow into the centrifugal rotary machine, if the foreign particles come into contact with the impeller during rotation, the foreign particles are discharged to a radially outer side of the impeller and stay between the impeller and the casing. There is a possibility that the foreign particle staying between the impeller and the casing cause an abrasion inside the centrifugal rotary machine or damage the inner portion of the centrifugal rotary machine.

The present invention provides a centrifugal rotary machine capable of removing foreign particles which flow into an impeller of the centrifugal rotary machine.

Solution to Problem

According to a first aspect of the present invention, there is provided a centrifugal rotary machine including: an impeller which includes a disk which is formed in a disk shape to be rotated around an axis, blades which are provided on a surface of the disk toward one side in an axial direction with an interval in a circumferential direction so as to define a flow path radially outward from the one side in the axial direction between the blades, and a cover which covers the blades from a radially outer side; a casing which accommodates the impeller inside the casing in a radial direction and has a gap formed between an outer peripheral surface of the cover and the casing; and a sealing device which seals the gap, in which the casing includes an end wall surface which is disposed to face one side of a cover end surface in an axial direction toward one side of the cover in an axial direction to extend in a radial direction and defines a radial flow path between the end wall surface and the cover end surface, an inlet-side inner peripheral surface which is connected to a radially inner side of the end wall surface and extends to the one side in the axial direction so as to define an introduction flow path of a fluid to the impeller, and a circulation flow path which is found in the casing and is open to an end portion on a radially outer side of the end wall surface and the inlet-side inner peripheral surface to cause the radial flow path and the introduction flow path to communicate with each other.

According to the centrifugal rotary machine of the first aspect, the foreign particles which come into contact with the cover end surface move to a radially outer side of the impeller, and thereafter, move to the inlet-side inner peripheral surface through the circulation flow path. Accordingly, it is possible to remove the foreign particles which enter a portion between the impeller and the casing.

According to a second aspect of the present invention, the casing may further include a jet passage which is open at a position of the end wall surface facing the gap and communicates with the circulation flow path.

According to a third aspect of the present invention, the jet passage may extend radially inward from the end wall surface toward the one side in the axial direction.

According to a fourth aspect of the present invention, the circulation flow path may be formed in a continuously annular shape about the axis of the disk when viewed in the axial direction of the disk.

According to a fifth aspect of the present invention, the circulation flow path may be formed at each of a plurality of locations which are separated from each other in the circumferential direction about the axis of the disk when viewed in the axial direction of the disk.

According to a sixth aspect of the present invention, the circulation flow path may include a joined portion which is inclined toward the other side of the disk in the axial direction along a direction approaching the axis of the disk.

Advantageous Effects of Invention

According to the centrifugal rotary machine, it is possible to remove the foreign particles which flow into the impeller of the centrifugal rotary machine.

DESCRIPTION OF EMBODIMENTS

Hereinafter, embodiments of the present invention will be described in detail with reference to the accompanying drawings. Note that, the drawings used in the description below are for describing the configuration of the embodiments of the present invention, and sizes, thicknesses, dimensions, or the like of respective portions which are shown may be different from a dimensional relationship of an actual centrifugal rotary machine and sealing device.

First Embodiment

Figure 1:
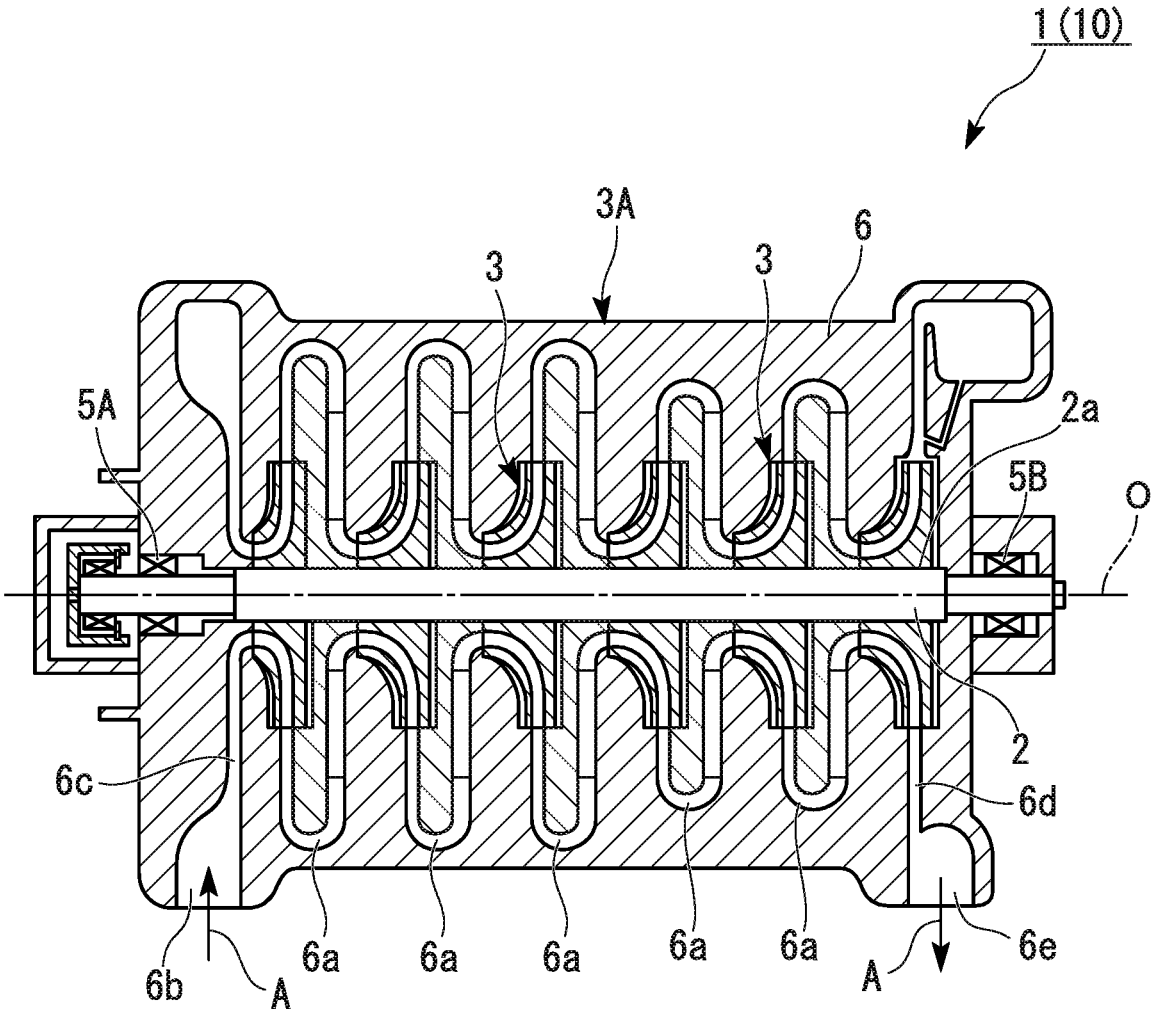
FIG. 1 is a sectional view showing a schematic configuration of a centrifugal rotary machine according to a first embodiment of the present invention.
Figure 2:
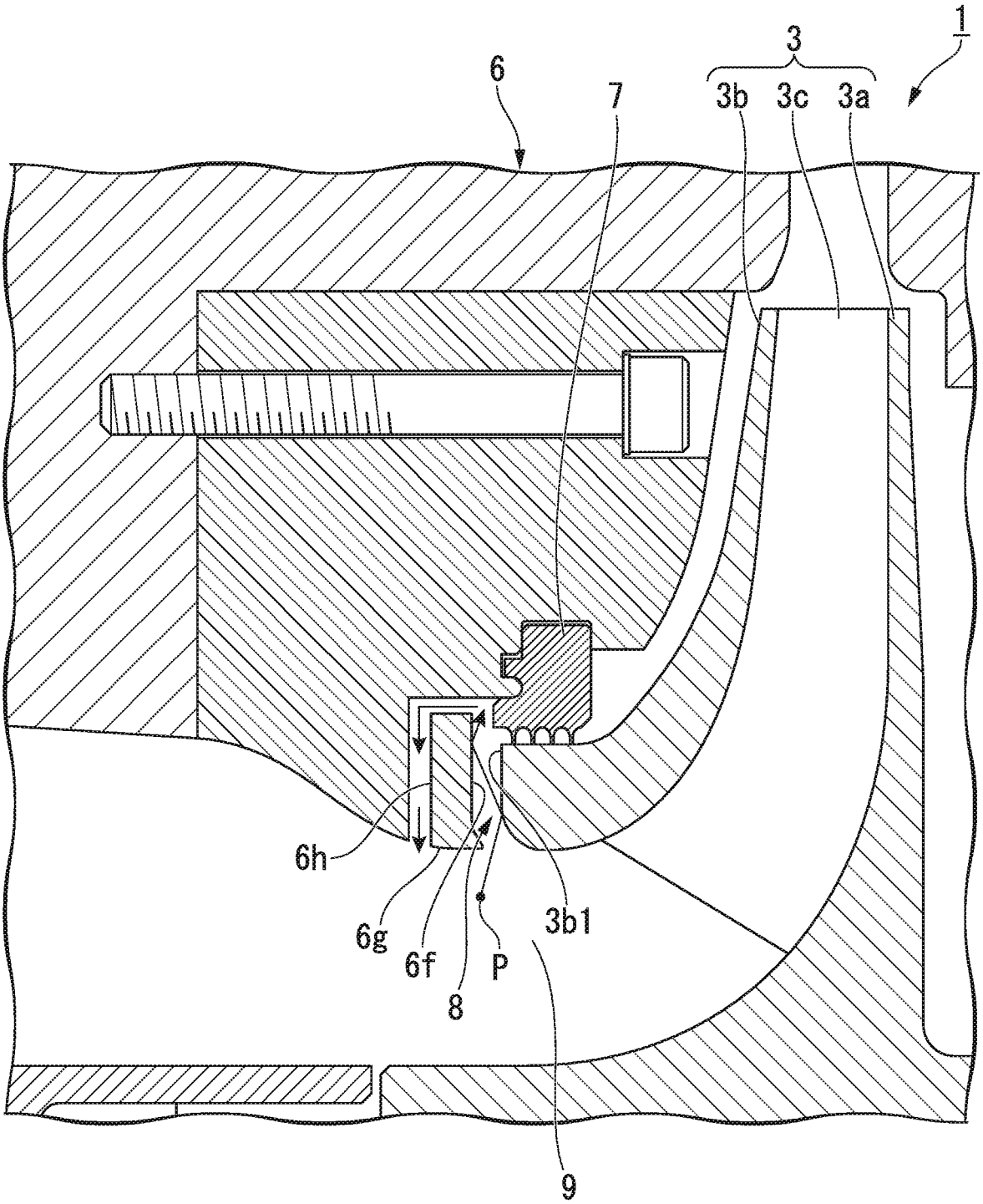
FIG. 2 is an enlarged view of an impeller in FIG. 1.

A first embodiment of the present invention will be described. FIG. 1 is a sectional view showing a schematic configuration of a centrifugal rotary machine according to the first embodiment of the present invention. FIG. 2 is an enlarged view of an impeller in FIG. 1. FIG. 1 shows a cross section in a case where a centrifugal rotary machine 1 is cut such that a rotary shaft 2 is divided into two on a virtual plane parallel in an extension direction of the rotary shaft 2.

In FIG. 1, a reference numeral A indicates a movement direction of a fluid (for example, a process gas) and a reference numeral O indicates an axis of the rotary shaft 2, respectively.

Referring to FIGS. 1 and 2, the centrifugal rotary machine 1 of the first embodiment includes the rotary shaft 2, an impeller 3, a pair of bearings 5A and 5B, a casing 6, and a sealing device 7.

The rotary shaft 2 is a columnar member which extends in a direction which is the same as an extension direction (an axial direction) of the axis O. In the rotary shaft 2, both ends (a first end and a second end) of the rotary shaft which are disposed in the extension direction of the axis O are rotatably supported by the bearings 5A and 5B, respectively. The rotary shaft 2 is rotated in one direction. The rotary shaft 2 has an outer peripheral surface 2*a* which is a curved surface.

The impeller 3 is provided on the outer peripheral surface 2*a* of the rotary shaft 2 which is disposed between the bearing 5A and the bearing 5B. The impeller 3 includes a disk 3*a*, a cover 3*b*, and a plurality of blades 3*c*.

The disk 3*a* is provided from one end (the first end) of the rotary shaft 2 toward the other end (the second end) of the rotary shaft 2 in the axial direction such that a diameter of the disk 3*a* gradually increases toward an outer side of the rotary shaft 2 in a radial direction. For example, a shape of the disk 3*a* may be, a substantially disk shape. An axis of the disk 3*a* is coaxial with the axis O of the rotary shaft 2. Hereinafter, the axis of the disk 3*a* is also indicated by the "axis O".

The cover 3*b* is provided so as to face the disk 3*a*. The cover 3*b* covers the plurality of blades 3*c*.

The plurality of blades 3*c* are radially provided outside the disk 3*a* so as to be separated from the disk 3*a*. The blades 3*c* define flow paths which are radially outward from one side of the disk 3*a* in the axial direction.

In the first embodiment, a multi-stage impeller group 3A is configured by a plurality of the impellers 3 which are aligned coaxially in the extension direction of the axis O of the rotary shaft 2.

The bearing 5A rotatably supports the one end (the first end) of the rotary shaft 2. The bearing 5B rotatably supports the other end (the second end) of the rotary shaft 2.

The casing 6 is formed in a tubular shape and supports the bearings 5A and 5B from an outer side. The casing 6 accommodates the rotary shaft 2, the impeller 3, and the sealing device 7 inside the casing 6 in a radial direction.

The casing 6 is configured such that the rotary shaft 2 and the impeller 3 can be rotated with respect to the casing 6.

The casing 6 includes a casing flow path 6*a*, a suction port 6*b*, connection flow paths 6*c* and 6*d*, and a discharge port 6*e*. In the casing 6, the casing flow path 6*a*, the suction port 6*b*, the connection flow paths 6*c* and 6*d*, and the discharge port 6*e* are provided in a portion corresponding to an arrangement region of the multi-stage impeller group 3A.

In addition, the casing 6 includes an end wall surface 6*f*, an inlet-side inner peripheral surface 6*g*, and a circulation flow path 6*h*. In the casing 6, the end wall surface 6*f*, the inlet-side inner peripheral surface 6*g*, and the circulation flow path 6*h* are provided for each of the impellers 3 which configure the multi-stage impeller group 3A.

The casing flow path 6*a* is provided inside the casing 6 to connect the flow paths between the blades 3*c* configuring each of the impellers 3 to each other. The casing flow path 6*a* is configured to be formed in an annular shape in the casing 6 which is disposed outside the rotary shaft 2.

The suction port 6*b* is provided in the casing 6 which is disposed on the bearing 5A side. The suction port 6*b* sucks the fluid to introduce the sucked fluid into the casing flow path 6*a* through the connection flow path 6*c*.

The connection flow path 6*c* is provided in the casing 6 and is connected to the casing flow path 6*a* and the suction port 6*b*. The connection flow path 6*d* is provided in the casing 6 and is connected to the discharge port 6*e* and the casing flow path 6*a*.

The discharge port 6*e* discharges the fluid which has passed the connection flow path 6*d* to the outside of the casing 6.

The end wall surface 6*f* is disposed to face one side of a cover end surface 3*b*1 in an axial direction toward one side of the cover 3*b* in an axial direction and extends in the radial direction. In addition, the end wall surface 6*f* defines a radial flow path 8 between the end wall surface 6*f* and the cover end surface 3*b*1.

The radial flow path 8 is a flow path into which foreign particles P included in the fluid flowing in during an operation of the centrifugal rotary machine 1 can flow. The foreign particles P which enter the radial flow path 8 come into contact with the cover 3*b* of the rotated impeller 3, and thus, are moved to a radially outer side of the impeller 3.

The inlet-side inner peripheral surface 6*g* is connected to a radially inner side of the end wall surface 6*f*. The inlet-side inner peripheral surface 6*g* extends from an end portion on the radially inner side of the end wall surface 6*f* toward the one side in the axial direction. The inlet-side inner peripheral surface 6*g* defines an introduction flow path 9 of the fluid to the impeller 3.

The circulation flow path 6*h* is open to the end portion on a radially outer side of the end wall surface 6*f* and the inlet-side inner peripheral surface 6*g* to cause the radial flow path 8 and the introduction flow path 9 to communicate with each other. For example, the shape of the circulation flow path 6*h* may be a continuously annular shape about the axis O of the disk 3*a*, a shape having plural passages which are separated from each other in a circumferential direction about the axis O of the disk 3*a*, or the like.

If the circulation flow path 6*h* is formed in the continuously annular shape in the circumferential direction about the axis O of the disk 3*a*, the foreign particles P easily enter the circulation flow path 6*h*, which is favorable for foreign substance removal performance.

If the circulation flow path 6*h* is formed in a shape having plural passages which are separated from each other in the circumferential direction about the axis O of the disk 3*a*, it is favorable for aerodynamic performance of the centrifugal rotary machine 1.

As shown in FIG. 2, the sealing device 7 is disposed in a gap between the impeller 3 and the casing 6. The sealing device 7 of the first embodiment is a so-called labyrinth seal. The sealing device 7 seals the gap between the impeller 3 and the casing 6 in a state of having a predetermined clearance with respect to the cover 3*b* of the impeller 3. The sealing device 7 is connected to the casing 6.

An operation of the centrifugal rotary machine 1 of the first embodiment will be described.

When the centrifugal rotary machine 1 of the first embodiment is operated, if the foreign particles P in the fluid come into contact with the cover 3*b*, the foreign particles P are moved to the radially outer side of the impeller 3 by the impeller 3. If the foreign particles P are moved to the radially outer side of the end wall surface 6*f*, the foreign particles P enter the circulation flow path 6*h* and are moved to the inlet-side inner peripheral surface 6*g*. The foreign particles P which reach the inlet-side inner peripheral surface 6*g* are moved to the impeller 3 by the fluid flowing through the introduction flow path 9.

In this way, according to the centrifugal rotary machine 1 of the first embodiment, the foreign particles P do not stay in the vicinity of the end portion on the radially outer side of the end wall surface 6*f*, and it is possible to return the foreign particles P to the introduction flow path 9 through the circulation flow path 6*h*. Therefore, since it is possible to quickly remove the foreign particles P which reach the vicinity of the end portion on the radially outer side of the end wall surface 6*f* from the gap between the impeller 3 and the casing 6, wear caused by continuous collision of the foreign particles P with the casing 6, the impeller 3, or the like does not easily occur.

Second Embodiment

Figure 3:
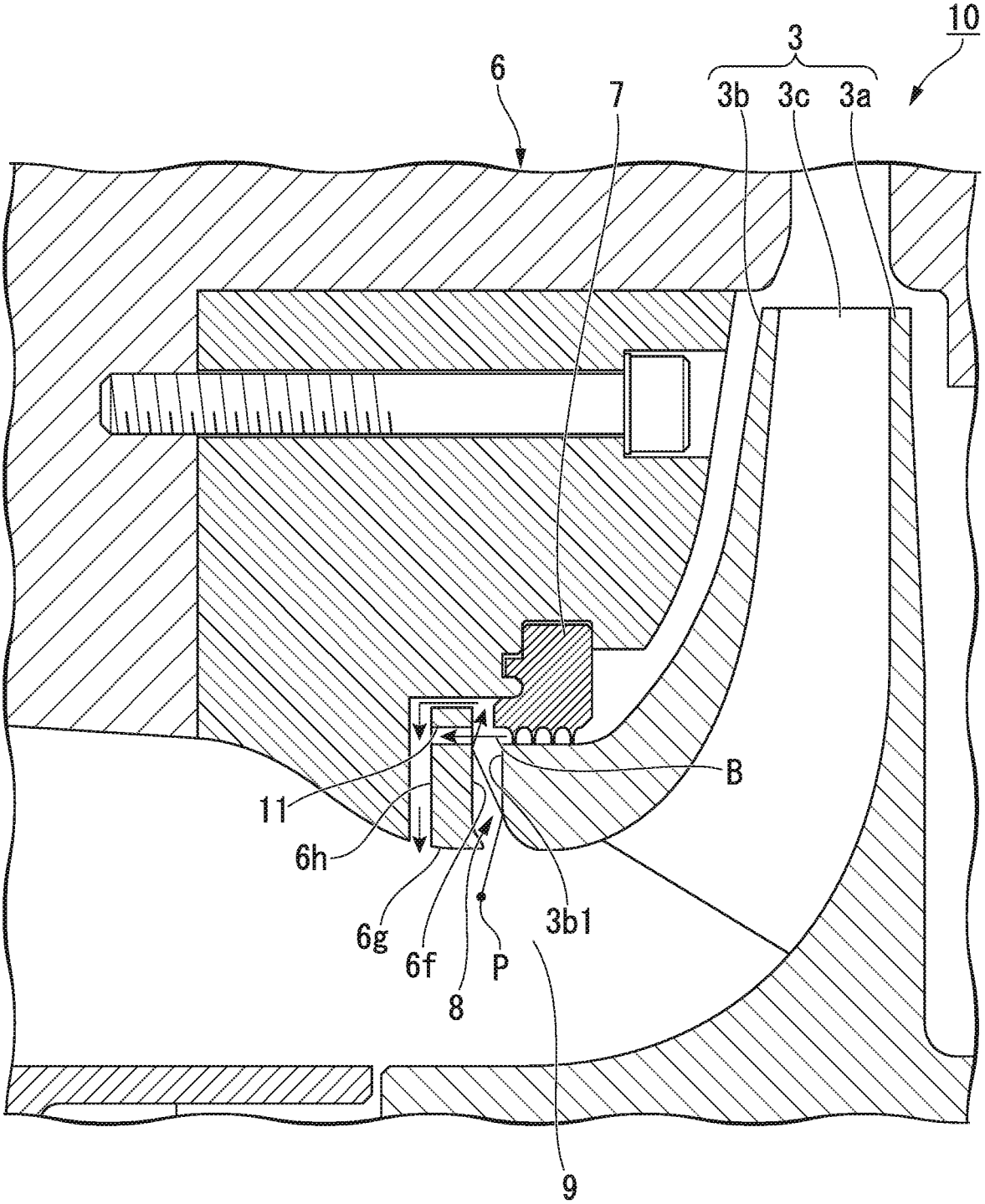
FIG. 3 is an enlarged sectional view showing an impeller of a centrifugal rotary machine according to a second embodiment of the present invention.

A second embodiment of the present invention will be described. FIG. 3 is an enlarged sectional view showing an impeller of a centrifugal rotary machine according to the second embodiment.

A centrifugal rotary machine 10 of the second embodiment shown in FIG. 3 includes a jet passage 11 which is a flow path of a fluid (a flow direction thereof is indicated by reference numeral B in FIG. 3) flowing through a clearance portion between a sealing device 7 and a cover 3*b*.

The jet passage 11 is open at a position of an end wall surface 6*f* facing a gap between the sealing device 7 and the cover 3*b*. In addition, the jet passage 11 communicates with the circulation flow path 6*h*.

In the second embodiment, since a pressure on an upstream side of the impeller 3 is high and a pressure on a downstream side of the impeller 3 is low, the fluid flows toward the one side of the disk 3*a* in a direction of the axis O between the sealing device 7 and the cover 3*b*. Here, the fluid flowing from the portion between the sealing device 7 and the cover 3*b* enters the jet passage 11 and flows toward the circulation flow path 6*h*. Therefore, in the second embodiment, foreign particles P gathered in the end portion on the radially outer side of the end wall surface 6*f* are placed on the fluid flowing from the portion between the sealing device 7 and the cover 3*b*, and thus, can be returned to the introduction flow path 9 through the circulation flow path 6*h*.

Modified Example

Figure 4:
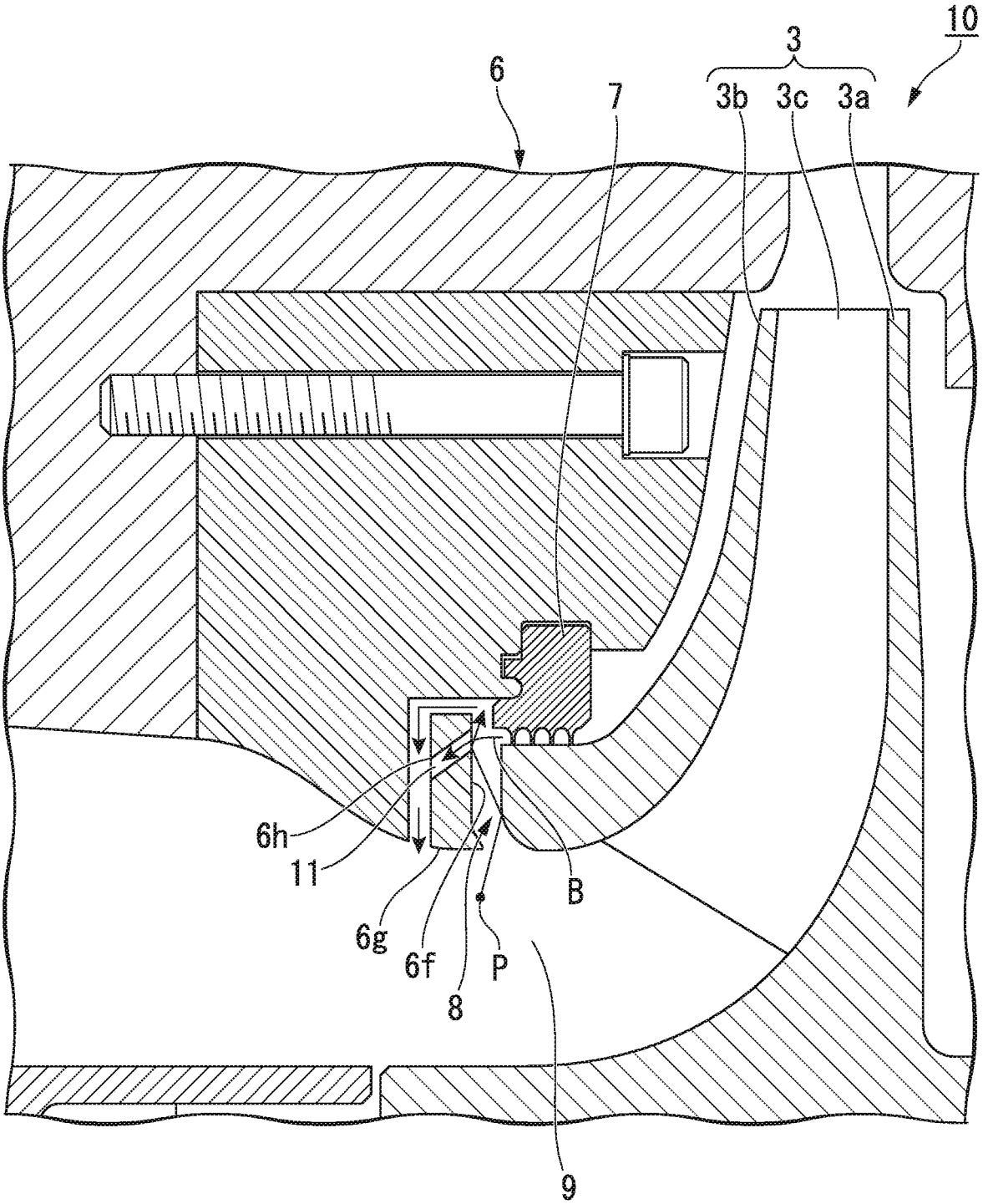
FIG. 4 is an enlarged sectional view showing a modified example of an impeller of a centrifugal rotary machine according to the second embodiment of the present invention.

A modified example of the second embodiment will be described. FIG. 4 is an enlarged sectional view showing an impeller of a centrifugal rotary machine of the present modified example.

As shown in FIG. 4, in the present modified example, the jet passage 11 extends radially inward from the end wall surface 6*f* toward the one side in the axial direction. In this case, in the circulation flow path 6*h*, a stagnation of the fluid may occur on an upstream side (a radially outer-side portion) of a joined portion of the jet passage 11 and the circulation flow path 6*h*. As a result, in the present modified example, it is possible to prevent the fluid from flowing from the jet passage 11 to the radially outer-side portion of the end wall surface 6*f* through the circulation flow path 6*h*, and it is possible to efficiently return the foreign particles P to the introduction flow path 9.

Modified Example

Figure 5:
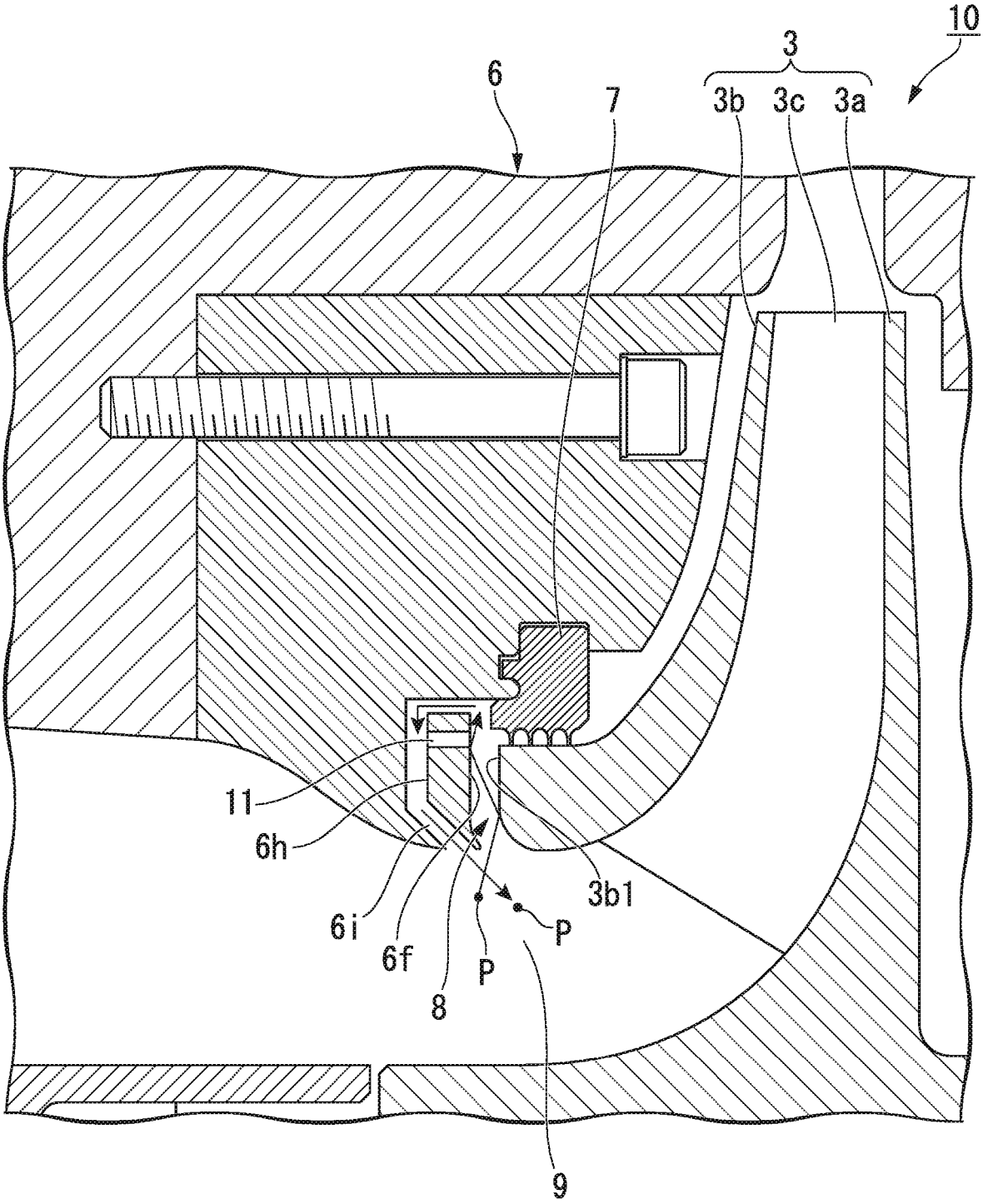
FIG. 5 is an enlarged sectional view showing another modified example of an impeller of a centrifugal rotary machine according to the second embodiment of the present invention.

Another modified example of the second embodiment will be described. FIG. 5 is an enlarged sectional view showing an impeller of a centrifugal rotary machine of another modified example.

As shown in FIG. 5, in the present modified example, the circulation flow path 6*h* includes a joined portion 6*i* which is inclined toward the other side of the disk 3*a* in the axial direction along a direction approaching the axis O of the disk 3*a*. That is, in the present modified example, the circulation flow path 6*h* is inclined in the vicinity of the inlet-side inner peripheral surface 6*g* so that the foreign particles P can be discharged along a flow of the fluid flowing through the introduction flow path 9.

In the present modified example, it is possible to reduce a joining loss between the circulation flow path 6*h* and the introduction flow path 9 and to increase efficiency of the centrifugal rotary machine 10.

Note that, a shape of the joined portion 6*i* may be a linear shape (refer to FIG. 5) which is inclined toward the other side of the disk 3*a* in the axial direction along the direction approaching the axis O of the disk 3*a* or may be a curved shape (not shown) which is gradually curved in a direction along the flow of the fluid flowing through the introduction flow path 9.

Hereinbefore, the embodiments of the present invention are described with the reference to the drawings, but specific configurations are not limited to the embodiments, and modifications in design may be included in the present invention within a scope which does not depart from the gist of the present invention.

For example, the circulation flow path 6*h* and the jet passage 11 disclosed in the second embodiment may share an opening on the end wall surface. In addition, the jet passage 11 disclosed in the second embodiment may communicate with the introduction flow path 9 without being joined to the circulation flow path 6*h*.

In addition, components shown in the embodiments and modified examples described above can be configured to be appropriately combined with each other.

INDUSTRIAL APPLICABILITY

According to the centrifugal rotary machine, it is possible to remove foreign particles which flow into the impeller of the centrifugal rotary machine.

REFERENCE SIGNS LIST

1, 10: centrifugal rotary machine
2: rotary shaft
2*a*: outer peripheral surface
3: impeller
3*a*: disk
3A: multi-stage impeller group

3*b*: cover
3*b*1: cover end surface
3*c*: blade
5A: bearing
5B: bearing
6: casing
6*a*: casing flow path
6*b*: suction port
6*c*: connection flow path
6*d*: connection flow path
6*e*: discharge port
6*f*: end wall surface
6*g*: inlet-side inner peripheral surface
6*h*: circulation flow path
6*i*: joined portion
7: sealing device
8: radial flow path
9: introduction flow path
10: centrifugal rotary machine
11: jet passage
P: foreign particles

The invention claimed is:

1. A centrifugal rotary machine comprising:

an impeller which includes a disk which is formed in a disk shape to be rotated around an axis, blades which are provided on a surface of the disk toward one side in an axial direction with an interval in a circumferential direction so as to define a flow path radially outward from the one side in the axial direction between the blades, and a cover which covers the blades from a radially outer side;

a casing which accommodates the impeller inside the casing in a radial direction and has a gap formed between an outer peripheral surface of the cover and the casing; and a sealing device which seals the gap, wherein the casing includes:

an end wall surface which is disposed to face one side of a cover end surface in an axial direction toward one side of the cover in an axial direction to extend in a radial direction and defines a radial flow path between the end wall surface and the cover end surface, an inlet-side inner peripheral surface which is connected to a radially inner side of the end wall surface and extends to the one side in the axial direction so as to define an introduction flow path of a fluid to the impeller, a circulation flow path which is formed in the casing and is open to an end portion on a radially outer side of the end wall surface and the inlet-side inner peripheral surface to cause the radial flow path and the introduction flow path to communicate with each other, and a jet passage which is open at a position of the end wall surface facing the gap and communicates with the circulation flow path.

2. The centrifugal rotary machine according to claim 1, wherein the jet passage extends radially inward from the end wall surface toward the one side in the axial direction.

3. The centrifugal rotary machine according to claim 2, wherein the circulation flow path is formed in a continuously annular shape about the axis of the disk when viewed in the axial direction of the disk.

4. The centrifugal rotary machine according to claim 3, wherein the circulation flow path includes a joined portion which is inclined toward the other side of the disk in the axial direction along a direction approaching the axis of the disk.

5. The centrifugal rotary machine according to claim 2, wherein the circulation flow path is formed at each of a plurality of locations which are separated from each other in the circumferential direction about the axis of the disk when viewed in the axial direction of the disk.

6. The centrifugal rotary machine according to claim 5, wherein the circulation flow path includes a joined portion which is inclined toward the other side of the disk in the axial direction along a direction approaching the axis of the disk.

7. The centrifugal rotary machine according to claim 2, wherein the circulation flow path includes a joined portion which is inclined toward the other side of the disk in the axial direction along a direction approaching the axis of the disk.

8. The centrifugal rotary machine according to claim 1, wherein the circulation flow path is formed in a continuously annular shape about the axis of the disk when viewed in the axial direction of the disk.

9. The centrifugal rotary machine according to claim 8, wherein the circulation flow path includes a joined portion which is inclined toward the other side of the disk in the axial direction along a direction approaching the axis of the disk.

10. The centrifugal rotary machine according to claim 1, wherein the circulation flow path is formed in a continuously annular shape about the axis of the disk when viewed in the axial direction of the disk.

11. The centrifugal rotary machine according to claim 10, wherein the circulation flow path includes a joined portion which is inclined toward the other side of the disk in the axial direction along a direction approaching the axis of the disk.

12. The centrifugal rotary machine according to claim 1, wherein the circulation flow path is formed at each of a plurality of locations which are separated from each other in the circumferential direction about the axis of the disk when viewed in the axial direction of the disk.

13. The centrifugal rotary machine according to claim 12, wherein the circulation flow path includes a joined portion which is inclined toward the other side of the disk in the axial direction along a direction approaching the axis of the disk.

14. The centrifugal rotary machine according to claim 1, wherein the circulation flow path includes a joined portion which is inclined toward the other side of the disk in the axial direction along a direction approaching the axis of the disk.

* * * * *